US007415733B2

(12) United States Patent
Rampersad

(10) Patent No.: US 7,415,733 B2
(45) Date of Patent: Aug. 26, 2008

(54) CLOTHING ADHERABLE KNEE PADS

(76) Inventor: Kenrick Rampersad, 159 Merrill St., Brentwood, NY (US) 11717

( * ) Notice: Subject to any disclaimer, the term of this patent is extended or adjusted under 35 U.S.C. 154(b) by 72 days.

(21) Appl. No.: 11/317,430

(22) Filed: Dec. 23, 2005

(65) Prior Publication Data

US 2006/0137071 A1 Jun. 29, 2006

Related U.S. Application Data

(60) Provisional application No. 60/660,081, filed on Mar. 9, 2005, provisional application No. 60/639,495, filed on Dec. 27, 2004.

(51) Int. Cl.
*A41D 13/00* (2006.01)

(52) U.S. Cl. ..... 2/23; 2/24

(58) Field of Classification Search ..... 2/23, 2/24, 79, 231, 16, 908, 69, 911, 227, 267; 602/23, 26, 20

See application file for complete search history.

(56) References Cited

U.S. PATENT DOCUMENTS 891,533 A 6/1908 Gibbs
2,568,083 A 9/1951 Mitchell
3,168,746 A 2/1965 Smith
3,346,877 A 10/1967 Zirves
4,041,940 A * 8/1977 Frankel et al. ..... 602/26
4,561,123 A 12/1985 Hull
5,309,570 A 5/1994 Grimm
5,611,080 A 3/1997 Skottheim
6,317,888 B1 11/2001 McFarlane
6,347,403 B1 2/2002 Wilcox
6,704,938 B2 3/2004 Crockett
6,988,281 B1 * 1/2006 Jerome et al. ..... 2/24

* cited by examiner

*Primary Examiner*—Tejash Patel
(74) *Attorney, Agent, or Firm*—Alfred M. Walker

(57) ABSTRACT

A clothing adherable knee pad includes a bendable flexible arcuate pad which bends over the knee of a kneeling person. At least two linearly extending elastic, stretchable straps are connected at distal ends thereof each to a respective clothing engageable clip, which is attachable to a trousers leg of a pair of pants. The two or more linearly extending elastic, stretchable straps engage the knee pad by being attached thereto or by being woven through respective pairs of slits extending through the knee pad. The straps are of sufficient length so that when attached to clothing, such as pants, respective locations of the clips upon pants legs avoids uncomfortable encroachments to respective lateral and rear areas of the knee of the user.

16 Claims, 6 Drawing Sheets

FIG. 14
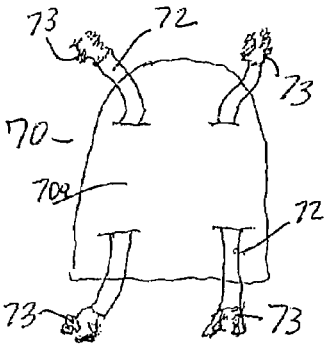
FIG. 16
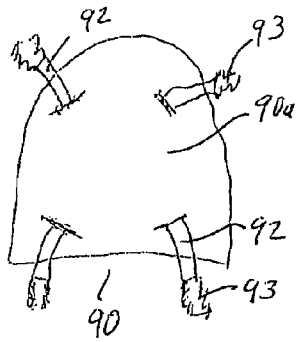
FIG. 21
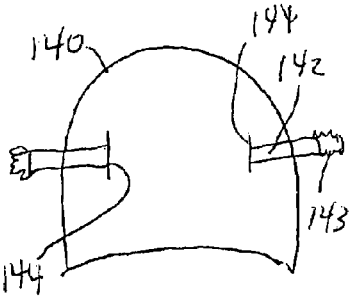
FIG. 19
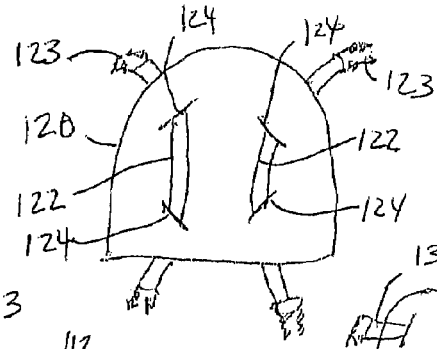
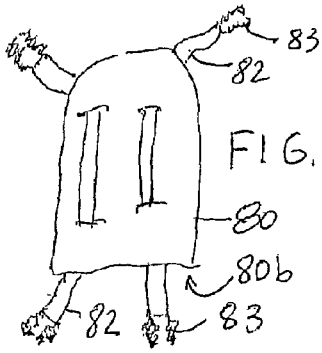
FIG. 15
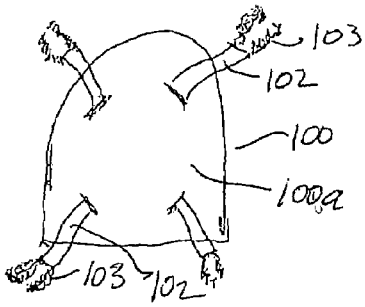
FIG. 17
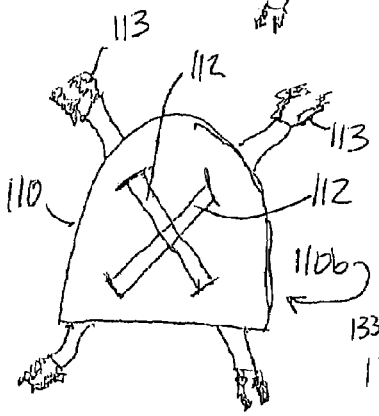
FIG. 18
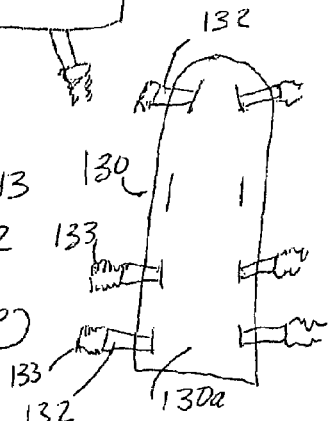
FIG. 20

CLOTHING ADHERABLE KNEE PADS

CROSS REFERENCE TO RELATED APPLICATIONS

This application claims the benefit, Under 35 U.S.C. 119 (e) of U.S. Provisional Application Nos. 60/639,495, filed Dec. 27, 2004 and 60/660,081, filed Mar. 9, 2005, which are hereby incorporated by reference.

FIELD OF THE INVENTION

The present invention relates to clothing adherable knee pads, which do not encroach upon the rear of the knee.

BACKGROUND OF THE INVENTION

Knee pads are widely used by workers in landscape, mechanics, plumbers, housekeepers and other occupations needed a kneeling position. However, knee pads can interfere with leg circulation when they are wrapped tightly around the knee.

Known knee pads which attach to trousers/pants legs include those described in U.S. Pat. No. 6,704,938 and its related US Patent Publication No. 2004/0019949, both of Crockett, for a protective knee pad which has a plurality of peripherally placed clips to attach the knee pad to clothing. However, in Crockett '949 the attachment straps are short, and there is no indication that the clips are elastically attached. Therefore, the clips can possibly provide an uncomfortable object adjacent to the sides of the sensitive knee area of a kneeling worker. For example, if positioning requires the user to move sideways, the fastener clips may be located uncomfortably between the lateral side area of the knee and the ground.

OBJECTS OF THE INVENTION

It is therefore an object of the present invention to provide an easily installable, clothing adherable knee pad, which avoids uncomfortable encroachments to the side lateral and rear areas of the knee.

SUMMARY OF THE INVENTION

In contrast to Crockett '949, in the present invention, the plastic or neoprene knee pads have long, elastic, stretchable straps connecting the clips, so that the user can vary where upon the trousers or pants legs the user wants to attach the clips, out of the way from the moving knee area. For example, excluding the attached clip, the elastic straps should preferably be at least two inches long, preferably three or more inches, so that the clips are not attached in the immediate area of the lateral side ligaments of the knee. Therefore, if the user wearing the knee pad has to move sideways, the clip will not present an uncomfortable impingement upon the sensitive lateral ligaments of the knee.

In one embodiment, four radially extending elastic straps extend from an outer surface of the knee pad.

In another embodiment, two pairs of long elastic straps for the clips are attached to the knee pad at its upper and lower edges.

In a further embodiment, the long elastic straps are woven through a pair of slits, starting underneath the knee pad, then through the first slit, across the front surface of the knee pad, then into the second slit and then underneath the knee pad at the opposite side of the knee pad.

Because of the long elastic straps, the user has wide latitude in positioning the clothing adherable clips away from the immediate knee area, so that the knee pad moves with the user and doesn't get in the way of the sensitive knee movement. Circulation is not stopped and pinching pain is substantially reduced or eliminated.

The present invention is therefore a knee pad for all occupations. Some of the groups using the knee pads of this invention would be contractors, masons, wood workers, carpet and tile installers, landscapers, housekeeping workers, mechanics, and do-it yourselfers. The knee pads of this invention are clipped to the sides of a trousers leg with no garment modifications required. Because of this positive attachment, the pad never falls down and is always in place. Since there is no band around the leg, there is no stress such as stopping of circulation or pinching. If placed correctly, these knee pads will move with the leg and knee always positioning themselves at the appropriate location.

A variety of embodiments ranging from homogenous rubber or plastic foam construction with straps threaded through slits to fabric covered or plastic shell molded versions are described. All pads have straps terminated in fabric clips, which engage the pants legs.

The first embodiment is the least expensive to manufacture. It includes a rectangular rubber or plastic foam pad with two horizontal slits near the top and near the bottom of the pad. Two straps are threaded through the four slits.

A second embodiment has the slits on the pad angled so that the threaded straps are angled up and down to engage the pants legs over a longer section to improve the positioning tenancy.

A third embodiment utilizes a molded foam pad with a slightly concave surface toward the knee. The outer convex surface of the pad is adhesively attached to a robust fabric layer (such as denim) to which the straps are pre-attached as by sewing. This fits more naturally over the knee.

A fourth embodiment uses a molded semi-rigid plastic shell lined with a rubber or plastic foam. This is convex on the outer side and concave toward the knee. Two slits on top and two towards the bottom accept the two attachment straps.

A fifth embodiment also uses a semi-rigid plastic shell lined with a foam layer, but the straps are attached using rivets. They may be attached on the exterior of the plastic shell, or on the interior foam surface.

In a sixth embodiment of this invention, a pad with a molded semi-rigid plastic shell is used wherein the shell is perforated with a buckle-type pattern adjacent the four corners. Four separate straps are attached to the buckle perforations by threading through the central bar and sewing the strap end to the strap body, or by engaging a spring clip riveted to the strap end to the central bar. In a seventh embodiment, a similar pad is used with four separate adjustable straps. The straps may be elastic as well. Each strap is threaded over the central bar of a buckle perforation and then the end with a female snap is snapped to one of several male snaps along the body of the strap.

In an eighth embodiment of this invention, a flexible foam knee pad is attached to the clothing by two straps which are each attached to the pad by threading through a pair of slits so that the strap ends emerge at the outer or top layer away from the knee. In this manner, the straps wrap around the edge of the knee pad accentuating the contouring of the knee pad around the knee. In addition, the upper slits are spaced further apart than the lower slits to better conform to the wider thigh above the knee and the narrower calf region below the knee. Although a single layer foam pad of medium density can be used, in the preferred implementation a more dense and abrasion resistant thinner top layer is adhered to a softer foam bottom layer which offers more cushioning and comfort to the knee. In another variation, the bottom foam layer is of a material modified so as to absorb heat upon exposure to radiation in a microwave oven and then release it slowly when in use. This is a therapeutic knee pad which will relieve pain due to injury or such joint ailments as arthritis. An alternative heat emitting construction is a one-time use knee pad with a bottom layer which is exothermic upon opening of an airtight package.

Other versions show various strap and pad orientations.

In all of the embodiments, the straps are sufficiently long enough so that the user can comfortably attach the fastener clips to areas of clothing away from the immediately adjacent lateral sides of the knee, so that if positioning requires the user to move sideways, the fastener clips will not be uncomfortably between the lateral side area of the knee and the ground.

BRIEF DESCRIPTION OF THE DRAWINGS

The present invention can best be understood in connection with the accompanying drawings. It is noted that the invention is not limited to the precise embodiments shown in drawings, in which:

FIG. 14 is a front view of a ninth embodiment for a knee pad showing straps running top to bottom and emerging through the front surface of the knee pad;

FIG. 15 is a front view of a tenth embodiment for a knee pad showing straps running top to bottom and emerging through the rear surface of the knee pad;

FIG. 16 is a front view of an eleventh embodiment for a knee pad showing straps running top to bottom and emerging through angled slits through the front surface of the knee pad;

FIG. 17 is a front view of a twelfth embodiment for a knee pad showing straps crisscrossing each other and emerging through the front surface of the knee pad;

FIG. 18 is a front view of a thirteenth embodiment for a knee pad showing straps crisscrossing each other and emerging through the rear surface of the knee pad;

FIG. 19 is a front view of a fourteenth embodiment for a knee pad showing straps running top to bottom and emerging through angled slits through the rear surface of the knee pad;

FIG. 20 is a front view of a fifteenth embodiment for a combination knee and shin pad showing straps emerging through the front surface thereof.

FIG. 21 is a front view of a sixteenth embodiment for a single strap knee pad.

DETAILED DESCRIPTION OF THE PREFERRED EMBODIMENTS

Figure 1:
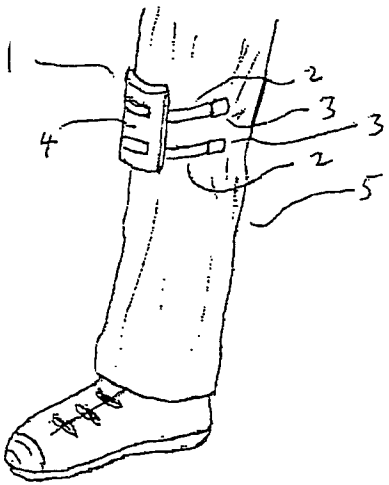
FIG. 1 is a perspective view of a trouser leg with a kneeling pad of this invention attached.

FIG. 1 shows the fabric attached knee pad 1 of this invention with flat foam pad 4 attached to the trousers leg 5 of a standing person via fabric clips 3 and relatively long straps 2, extending at least two or more inches away from the side edges of the knee pad 1.

Figure 2:
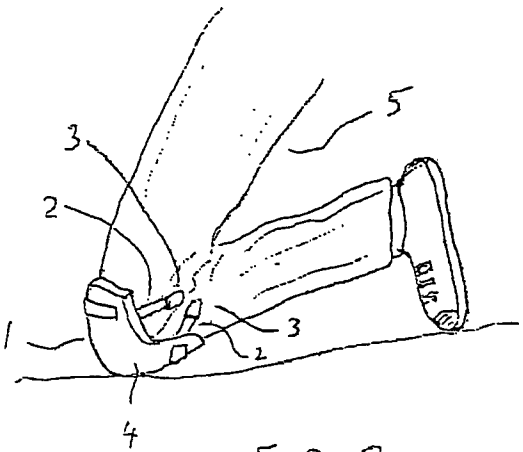
FIG. 2 is a perspective view of the same leg and pad in a kneeling position showing the conformability of the kneeling pad.

In FIG. 2, the same pad 1 is shown attached to leg 5 of a kneeling person. Note how pad 4 conforms to the knee in this position.

Figure 3:
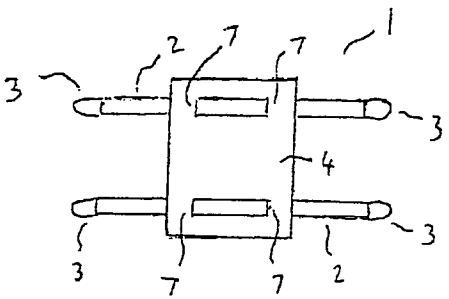
FIG. 3 is a front view of the pad of the first embodiment with two vertical strap slits near the top and near the bottom of the pad.

The first embodiment pad 1 is shown more clearly in FIG. 3 where straps 2 are shown threaded through vertical slits 7 in foam pad 4.

Figure 4:
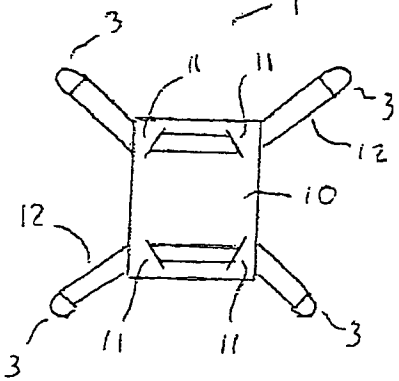
FIG. 4 is a front view of the second embodiment of this invention showing a foam pad with two angled slits near the top and two angled slits near the bottom of the pad.

FIG. 4 shows the second embodiment for knee pad 9 wherein straps 12 are threaded through angled slits 11 in flat foam pad 10.

Figure 5:
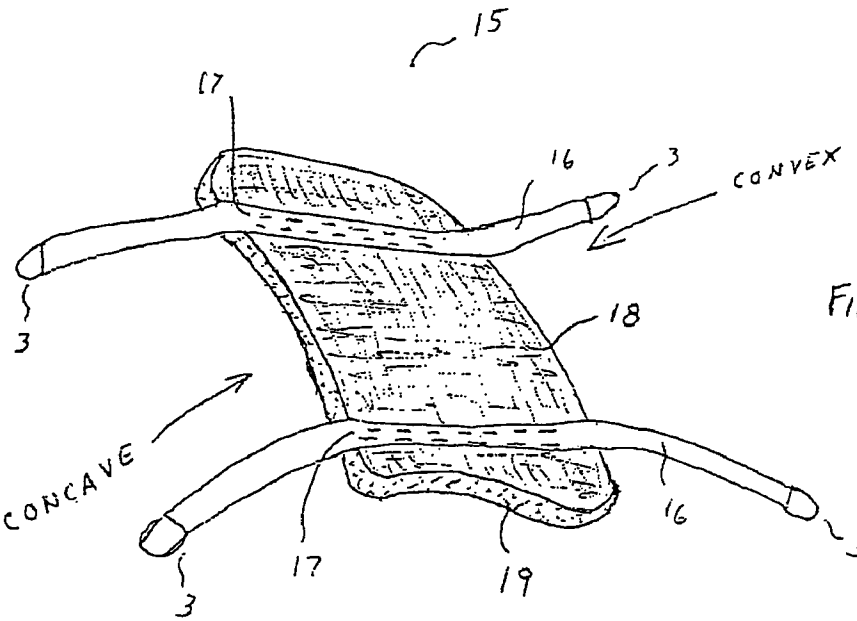
FIG. 5 is a perspective view of a molded foam pad, which is the third embodiment of this invention. This has a fabric outer surface with sewn straps.

The perspective view of FIG. 5 shows a third for a knee pad 15 with slightly contoured foam pad 9. The outer surface is covered with adhesively attached fabric 18 to which straps 16 are sewn with stitches 17.

Figure 6:
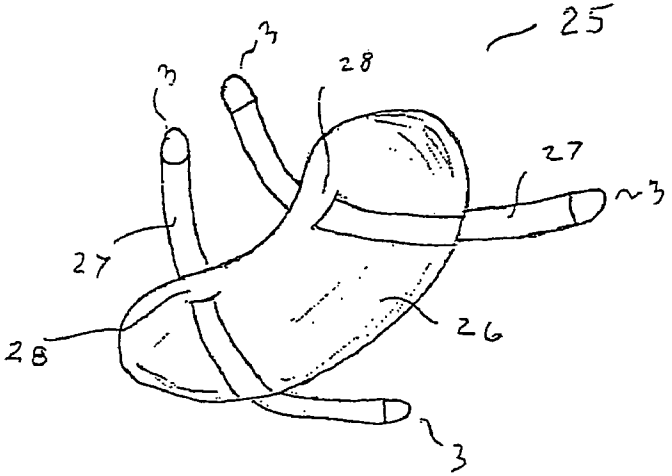
FIG. 6 is a perspective view of the fourth embodiment of this kneeling pad utilizing strap slits top and bottom through the molded shell and foam liner.

FIG. 6 shows a contoured knee pad 25 of the fourth embodiment in which foam lined plastic shell 26 is penetrated with four vertical slits (only two showing in this view) through which straps 27 are threaded.

Figure 8:
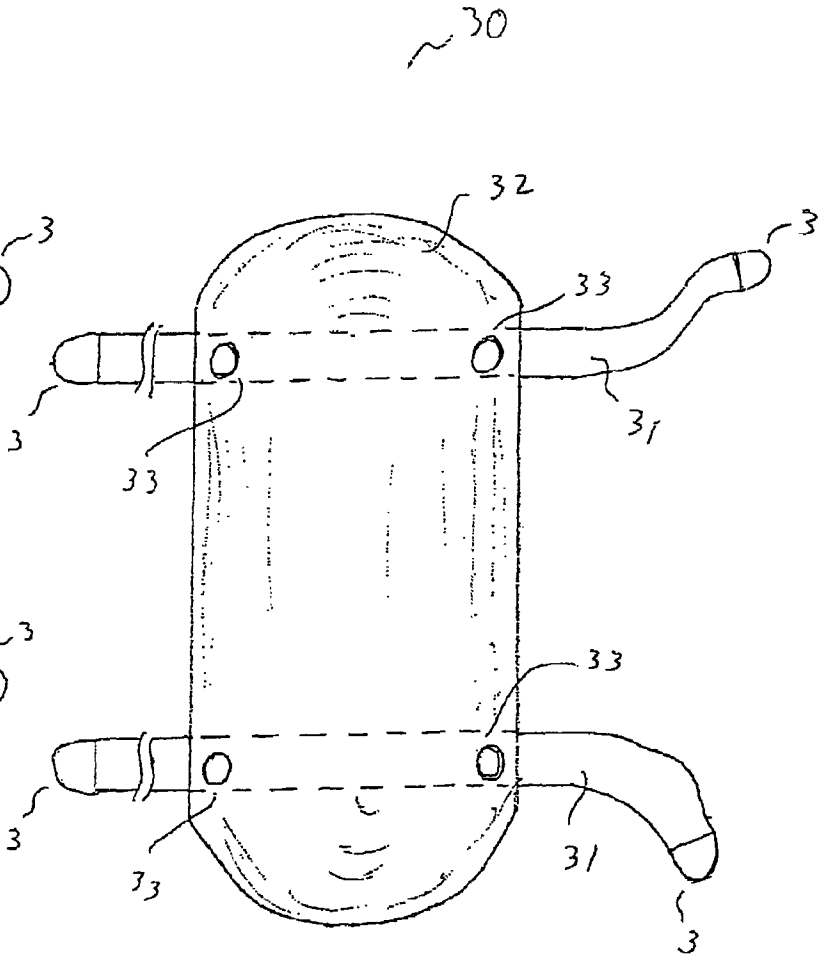
FIG. 8 is a front view of the fifth embodiment using rivets to attach straps on the interior foam liner surface.
Figure 7:
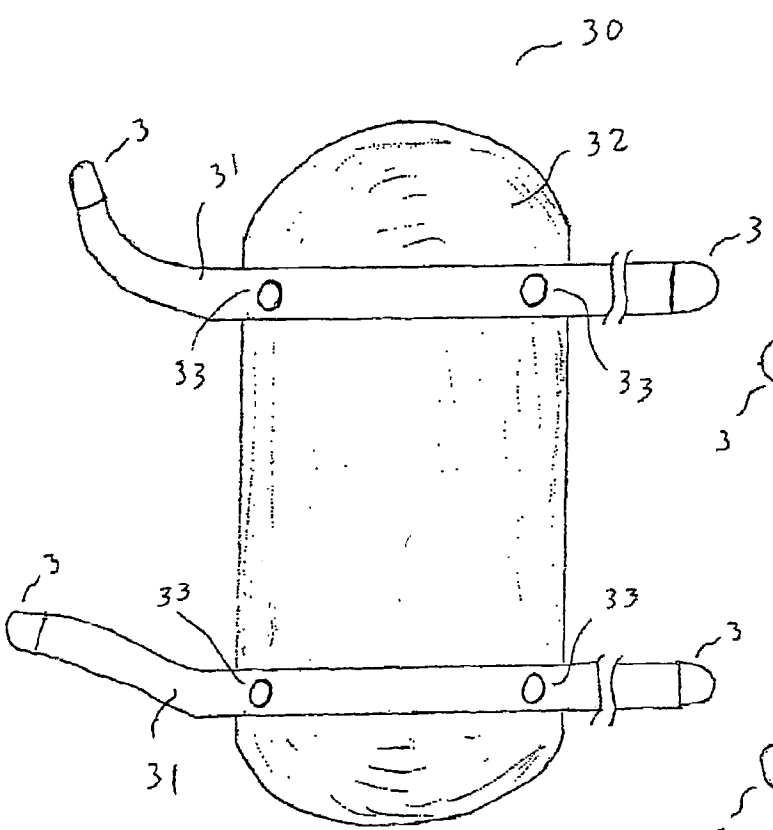
FIG. 7 is a front view of the fifth embodiment of this invention using a plastic shell with foam liner and further attaching straps on the exterior surface using rivets.

FIGS. 7 and 8 show two versions of the fifth embodiment of this invention with pad 25 having contoured outer shell 32 with foam lining (not shown).

In FIG. 7, straps 31 are riveted 33 to the outer surface of shell 32.

In FIG. 8, straps 31 are riveted 33 to the inner foam surface of shell 32.

Figure 9:
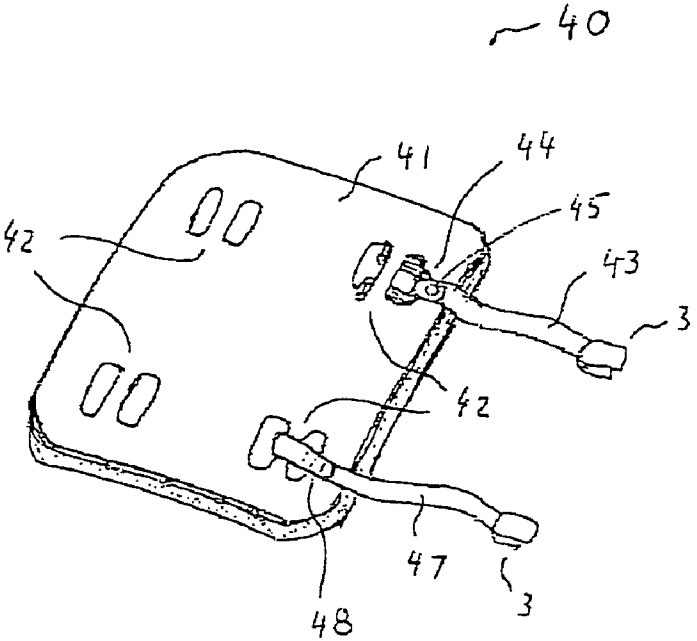
FIG. 9 is a perspective view of a sixth embodiment of this invention using four separate straps engaged in buckle-type perforations on a semi-rigid shell of the pad; and, FIG. 10 is a perspective view of a seventh embodiment wherein the shell of FIG. 9 is used with four adjustable straps.

FIG. 9 shows a sixth embodiment 40 with semi-rigid shell 41 having four buckle-type perforation patterns 42 near the four corners. Although only two straps are shown in the figure, four individual straps are used. The straps can be attached in two different ways. Strap 43 has clip 3 at one end and a plastic or metal spring clip 44 at the other end retained by rivet 45 or by sewing. Clips 3 and 43 may be made of metal, plastic or a combination thereof. Strap 43 is attached to shell 41 by passing clip 44 through perforation 42 and engaging the wings of clip 44 in the sides of the perforation past the central bar. This is facilitated by the curvature (not shown) of clip 44. Alternatively, a strap 47 can be used by simply engaging the central bar of a perforation 42 with the end and then sewing 48 the end to the body of strap 47.

Figure 10:
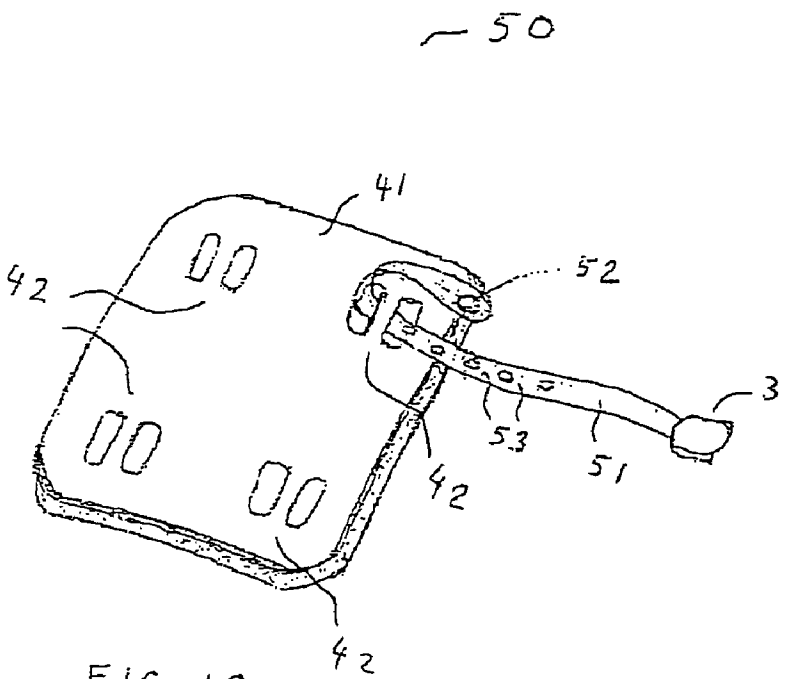

FIG. 10 shows a seventh embodiment 50 of a knee pad using four separate adjustable straps 51. Straps 51 have a clip 3 at one end and a row of male snaps 53 spaced apart in the vicinity of the opposite end. The distal end of strap 51 has a female snap 52, which can engage any of the male snaps 53 on strap 51. These straps 51 are attached to perforated shell 41 by threading each strap end with snap 52 through the perforation 42 and looping it over the central bar and then snapping onto one of snaps 53 adjusting the length as desired.

Figure 11:
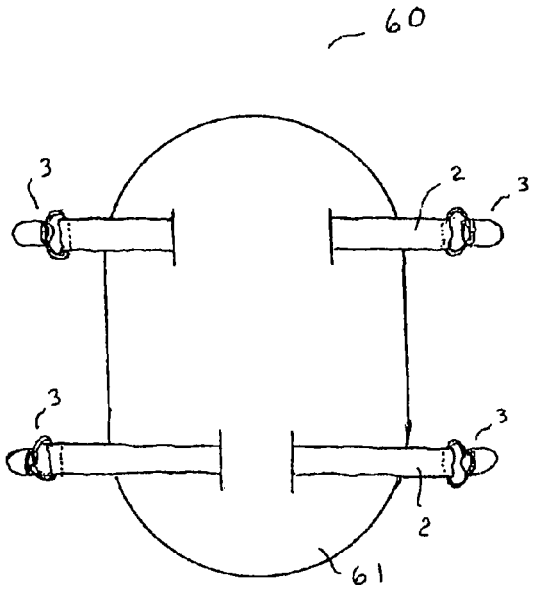
FIG. 11 is a front view of the eight embodiment knee pad showing attachment straps emerging slits at the top surface.
Figure 12:
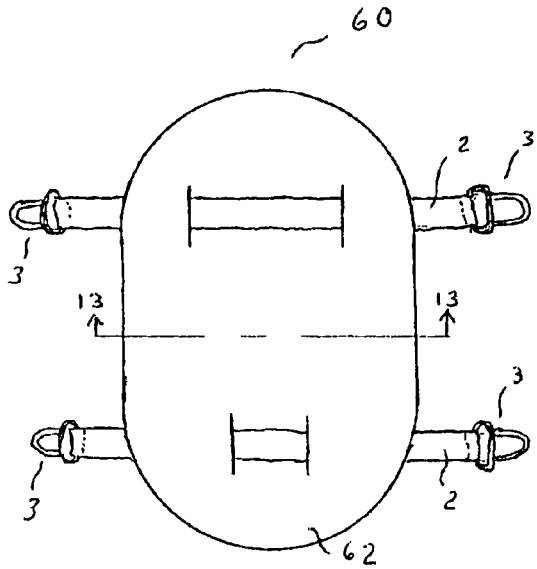
FIG. 12 is a bottom plan view showing the softer bottom foam layer.
Figure 13:
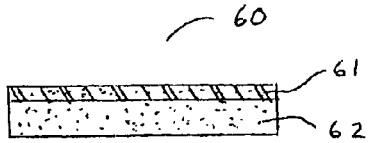
FIG. 13 is a crossection view showing the two layers of foam in knee pad of FIGS. 11 and 12.

The eighth embodiment of this invention is presented in FIGS. 11-13. Knee pad 60 has two widely spaced slits near the top and two closer spaced slits near the bottom. two straps 2 are threaded through these slits so that the ends of straps 2 (with clothing clips 3) emerge through the top surface layer 61. By wrapping around the edges of pad 60 to attach to a pants leg, pad 60 would conform more closely to the knee. The slit spacing, wider on top and closer at bottom, also aids in better conformability. In the preferred implementation, two different layers of foam are adhered together to form pad 60. This is shown clearly in the crossection of FIG. 13. Thinner top layer 61 is of a denser, more wear resistant foam. Layer 61 also affords the pad more stability and resists surface disintegration from rough surfaces such as concrete. Bottom layer 62 is a softer, more comfortable foam. In another variation, layer 62 is modified as by loading with fillers or by different chemical composition to absorb radiation in a microwave oven and thereby raise its temperature. This stored heat is then slowly released to the knee area in a therapeutic manner when strapped on. An alternative thermal release composition would become exothermic upon emerging from its packaging.

FIG. 14 shows a ninth embodiment for a knee pad 70 showing straps 72 with clips 73 running top to bottom and emerging through the front surface 70*a* of the knee pad 70.

FIG. 15 shows a tenth embodiment for a knee pad 80 showing straps 82 with clips 83 running top to bottom and emerging through the rear surface 80*b* of the knee pad 80.

FIG. 16 shows an eleventh embodiment for a knee pad 90 showing straps 92 with clips 93 running top to bottom and emerging through angled slits 94 through the front surface 90*a* of the knee pad 90.

FIG. 17 shows a twelfth embodiment for a knee pad 100 showing straps 102 with clips 103 crisscrossing each other and emerging through the front surface 100*a* of the knee pad 100.

FIG. 18 shows a thirteenth embodiment for a knee pad 110 showing straps 112 with clips 113 crisscrossing each other and emerging through the rear surface 110*b* of the knee pad 110.

FIG. 19 shows a fourteenth embodiment for a knee pad 120 showing straps 122 with clips 123 running top to bottom and emerging through angled slits 124 through the rear surface 120*b* of the knee pad 120.

FIG. 20 is a front view of a fifteenth embodiment for a combination knee and shin pad 130 showing straps 132 with clips 133 emerging through the front surface 130*a* of knee pad 130. This longer kneepad is especially useful for roofers or other persons having weight bearing contact on both the knees and shins. This longer kneepad 130 can extend from knee to ankle. It is noted that the straps 132 may be oriented in other orientations, such as running top to bottom (not shown), crisscrossed (not shown), through angled slits (not shown) or side to side, as shown.

FIG. 21 shows knee pad 140 with a single strap 142 with a pair of clips 143 extending through slits 144. This strap 142 can be woven in other orientations, with or without horizontal, vertical or angled slits.

It is further noted that the aforesaid knee pads 1, 9, 15, 25, 30, 40, 50, 60, 70, 80, 90, 100, 110 and/or 120 may have different orientations of the straps and clips with respect to the knee pads, without departing from the scope of the invention.

Furthermore, the knee pads can have optional protective shells, coverings or jackets placed over them as necessary for field or work conditions. They can be of various materials, such as foams, sponges, gels or other compressible materials known to those skilled in the art. They may have an optional firmer cover of plastic or other materials. The covers can be camouflaged for hunters, such as green camouflage for bush or field hunting or brownish/grayish for duck hunting.

All methods of weaving the clips and straps applies alternatively to all of the above noted versions, with no limits as to materials (foam, plastics, sponges, rubber, nylon, neoprene, cloth, etc.) known to those skilled in the art.

Additionally, extra padding can be added to selected portions of the knee pad as desired. While the aforesaid knee pads are designed for use in work or field conditions, it is also noted that they may be used domestically in a house or apartment for persons who have knee conditions which require padding during normal household chores, such as cleaning floors, or gardening. Additionally, the knee pads can be used for providing heat to knees, either by themselves or with auxiliary heating pads worn adjacent thereto.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention.

I claim:

1. A clothing knee pad comprising:

a bendable flexible arcuate knee pad having side edges;

at least two pairs of slits in said knee pad, said at least two pairs of slits adjacent opposite side edges, respectively;

at least two elastic straps extending through each of said at least two pairs of slits, each of said at least two straps slidably attached to said knee pad;

a clothing engageable clip mounted on each distal end of each said at least two straps for attachment to a pants leg worn by a user for positioning of said pad over a knee for protection of said knee, the clip is solely attached to the pant leg with no additional fastening devices, wherein each of the at least two pairs of slits is angularly positioned in a corner of said knee paid in a manner such that at least two straps extend diagonally across each other.

2. The clothing knee pad as in claim 1 wherein further each said at least two straps extends inward through one slit and outward through another slit, and then bends over itself;

wherein further respective distal ends of each said at least two straps engage each other by a fastener means.

3. A clothing knee pad comprising:

a bendable, flexible arcuate knee pad having side edges; at least two pair of slits in said knee pad, said at least two pair of slits adjacent opposite side edges, respectively;

at least two elastic straps extending through each of said at least two pair of slits, each of said at least two straps slidably attached to the knee pad; a clothing engageable clip mounted on each distal end of each of said at least two straps for attachment to a pant leg worn by a user for positioning of said knee pad over a knee for protection of the knee;

the clip is solely attached to the pant leg with no additional fastening devices, wherein each of the at least two pair of slits is angularly positioned in a corner of said knee pad in a manner such that at least two straps are vertically woven through each of the at least two pair of slits, starting on one side of said knee pad, then through a first slit of each said pair of slits, across a surface of said knee pad, then into a second slit of said pair of slits, and then through said knee pad at an opposite side of said knee pad.

4. The clothing knee pad as in claim 1 wherein said at least two straps are woven through each said pair of slits, starting over said knee pad, then through a first slit of said pair of slits, across a rear surface underneath of said knee pad, then into a second slit of said pair of slits, and then over said knee pad at an opposite side of said knee pad.

5. The clothing knee pad as in claim 1 wherein said at least two straps are of sufficient length so that when attached to said pants leg, respective locations of said clips avoids uncomfortable encroachments to respective lateral and rear areas of the knee.

6. The clothing knee pad as in claim 1 further comprising a semi-rigid outer shell.

7. The clothing knee pad as in claim 1 wherein each said at least two straps are adjustable in length.

8. A clothing knee pad comprising:

a bendable, flexible arcuate knee pad having side edges; at least two pair of slits in said knee pad, said at least two pair of slits adjacent opposite side edges, respectively;

at least two elastic straps extending through each of said at least two pair of slits, each of said at least two straps slidably attached to the knee pad; a clothing engageable clip mounted on each distal end of each of said at least two straps for attachment to a pant leg worn by a user for positioning of said knee pad over a knee for protection of the knee;

the clip is solely attached to the pant leg with no additional fastening devices, wherein each of the at least two pair of slits is angularly positioned in a corner of said knee pad in a manner such that at least two straps are horizontally woven through each of the at least two pair of slits, starting on one side of said knee pad, then through a first slit of each said pair of slits, across a surface of said knee pad, then into a second slit of said pair of slits, and then through said knee pad at an opposite side of said knee pad.

9. The clothing knee pad as in claim 3 wherein further each said at least two straps extends inward through one slit and outward through another slit, and then bends over itself;

wherein further respective distal ends of each said at least two straps engage each other by a fastener means.

10. The clothing knee pad as in claim 3 wherein said at least two straps are of sufficient length so that when attached to said pants leg, respective locations of said clips avoids uncomfortable encroachments to respective lateral and rear areas of the knee.

11. The clothing knee pad as in claim 3 further comprising a semi-rigid outer shell.

12. The clothing knee pad as in claim 3 wherein each said at least two straps are adjustable in length.

13. The clothing knee pad as in claim 8 wherein further each said at least two straps extends inward through one slit and outward through another slit, and then bends over itself;

wherein further respective distal ends of each said at least two straps engage each other by a fastener means.

14. The clothing knee pad as in claim 8 wherein said at least two straps are of sufficient length so that when attached to said pants leg, respective locations of said clips avoids uncomfortable encroachments to respective lateral and rear areas of the knee.

15. The clothing knee pad as in claim 8 further comprising a semi-rigid outer shell.

16. The clothing knee pad as in claim 8 wherein each said at least two straps is are adjustable in length.

* * * * *